United States Patent [19]

Salter et al.

[11] Patent Number: 4,589,502

[45] Date of Patent: May 20, 1986

[54] EARTH BORING APPARATUS

[75] Inventors: Martin de G. Salter; John G. S. Hynd, both of Tucson, Ariz.

[73] Assignee: Cementation Company of America, Incorporated, Tucson, Ariz.

[21] Appl. No.: 607,166

[22] Filed: May 4, 1984

[51] Int. Cl.[4] ..... E21D 1/06

[52] U.S. Cl. ..... 175/102; 175/230

[58] Field of Search ..... 175/91, 94, 97, 98, 175/99, 102, 219, 230

[56] References Cited

U.S. PATENT DOCUMENTS

| | | | |
|---|---|---|---|
| 1,154,137 | 9/1915 | Sletter et al. . | |
| 3,185,226 | 5/1965 | Robbins | 175/102 |
| 3,379,264 | 4/1968 | Cox | 175/86 |
| 3,493,165 | 2/1970 | Schonfeld | 175/94 |
| 3,547,211 | 12/1970 | Christensen et al. | 175/86 |
| 3,695,370 | 10/1972 | Jones | 175/106 |
| 3,965,995 | 3/1975 | Sugden | 175/57 |
| 4,274,675 | 6/1981 | Paurat et al. | 299/31 |
| 4,312,541 | 1/1982 | Spurgeon | 175/94 |

*Primary Examiner*—Stephen J. Novosad
*Assistant Examiner*—William P. Neuder
*Attorney, Agent, or Firm*—Poms, Smith, Lande & Rose

[57] ABSTRACT

An earth boring or shaft sinking apparatus in which a column is continuously rotatable about its axis, the column including a cutting wheel at one end rotatable about a wheel axis normal to the axis of the column, the cutting wheel including sprockets mounted about the wheel axis, the sprockets providing engagement for an endless bucket-carrying chain for direct conveyance of cuttings from the bottom of a hole to the top end of the column, which includes another set of sprockets for the endless bucket-carrying chain and discharges the cuttings into a feed bin. The cutting wheel is continuously rotated about the column longitudinal axis, as well as its wheel axis of rotation. In one example, a main, enlarged, cone-shaped cutting head is rotatable with the column for rotation about the column axis at a selected rate of speed, while the cutting wheel is additionally rotated about its wheel axis at a different selected speed, rotation of the cutting wheel and of the cutting head being continuous, the cutting wheel providing an advancing central bowl shaped recess adapted to serve as a lead or pilot hole to receive cuttings from the second enlarged main cutting head. Different arrangements of cutting wheels and endless bucket means are provided.

7 Claims, 10 Drawing Figures

Fig. 6.
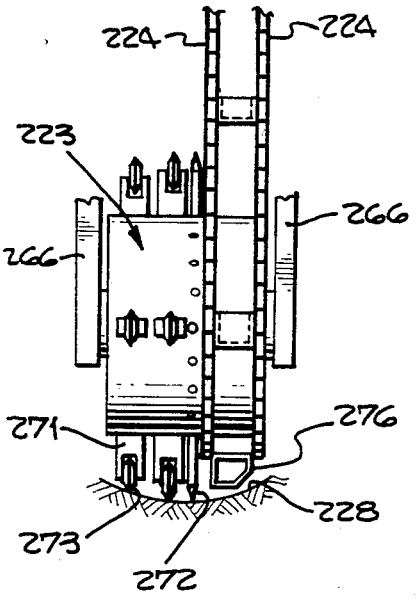
Fig. 7.
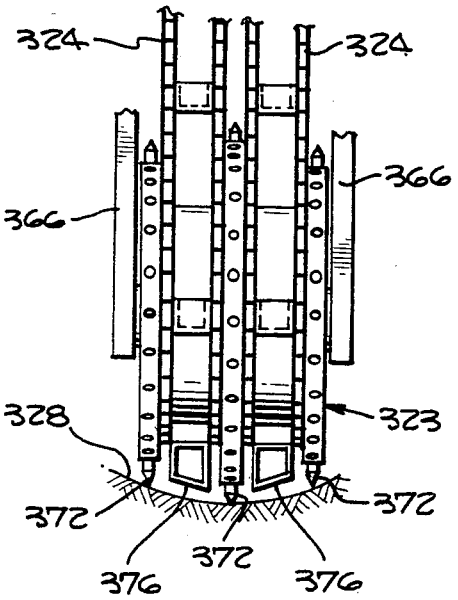
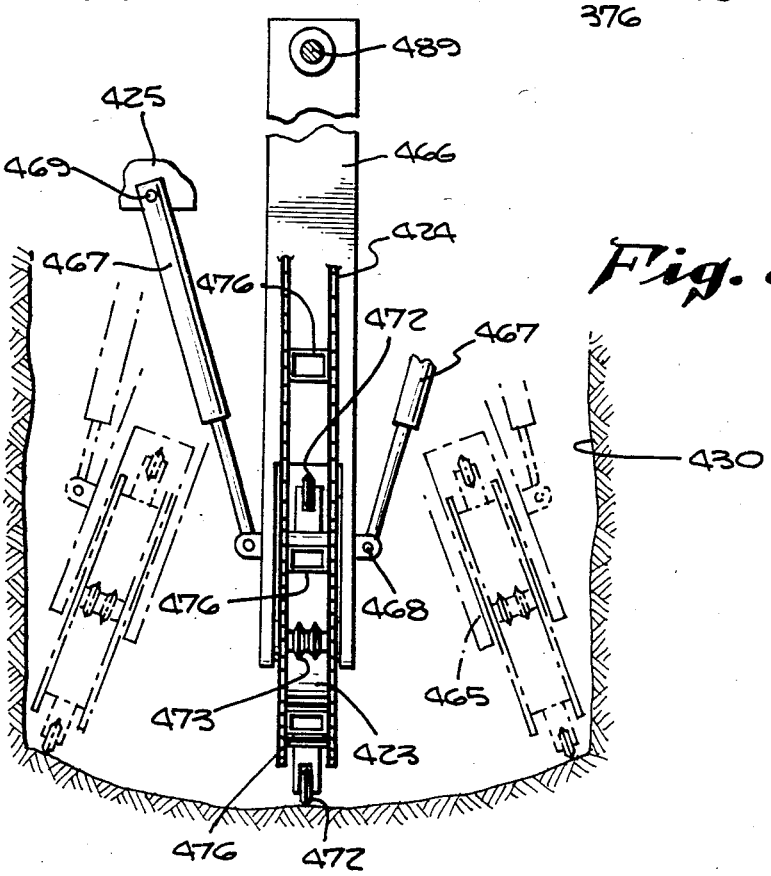
Fig. 8.

EARTH BORING APPARATUS

BACKGROUND OF INVENTION

This invention relates to an earth boring or shaft sinking apparatus in which a cutting wheel with cutting elements is continuously rotated about an axis normal to the direction of the hole to be bored, and also continuously rotated about an axis coinciding with the axis of the hole to be bored, and in which endless bucket means are associated with said cutting wheel and with a sprocket means remote from said cutting wheel, whereby cuttings in the hole can be collected by said bucket means and conveyed directly to a remote location for suitable disposal.

Prior proposed earth boring machines for making large holes or shafts in the order of 26 feet in diameter include a machine shown in Sugden U.S. Pat. No. 3,965,995, in which a cutter wheel carries cutting units and fixed buckets which are rotatable about the cutting wheel axis. The buckets fixed on the wheel discharge their collection of cuttings into separate vertical endless bucket means, which at its lower end passes through the center portion of the cutting wheel. The cutting wheel is rotated about its axis until a selected depth of cut is made, the cutting wheel is then raised and turned or shifted through a selected angle about the longitudinal axis of the hole to be cut, returned to its cutting position and then rotated about its wheel axis to cut additional earth material until it reaches the depth of the prior cut. Such incremental fixed angular cutting continues until a selected depth of hole is reached.

Another prior proposed earth boring machine is shown in Cox U.S. Pat. No. 3,379,264, in which a main frustoconical head is rotated about a vertical axis and an endless bucket means is provided centrally along said axis and through said main head for collecting cuttings made by the conical head and which fall into a prebored pilot hole into which the bucket means extends. The endless bucket means is movable vertically relative to the cutting head and is also rotatable about the vertical axis of the hole to be bored.

Another prior device is shown in Sletten, et al., U.S. Pat. No. 1,154,137, where a disk-like slicer-like cutter head is rotatable about a vertical axis and an endless bucket means passes immediately thereabove for collecting cuttings which are passed through openings in the disk-like cutter head.

Another prior proposed apparatus for drilling holes in earth formations is shown in Jones, U.S. Pat. No. 3,695,370, in which a peripheral cylindrical shaped cutting wheel with diamond bits is continuously rotatable about a horizontal axis and is continuously rotated about a vertical axis. Jones' drilling machine is for drilling oil wells of small diameter as compared to a shaft of over sixteen feet in diameter and includes the use of drilling mud to transport by fluid means cuttings made by the drill wheel.

Christianson, U.S. Pat. No. 3,547,211, discloses a mucking bucket rotatably mounted between the lower ends of a pair of links suspended for lateral pivotal movement from a rotatable turntable for a pendulum swinging-like motion, as well as rotation about a horizontal axis.

Prior proposed systems for handling the cuttings made by the cutting wheels or cutter heads have usually required collection of cuttings by one set of buckets and transfer of cuttings to a second set of buckets, that is, dual handling of the cuttings at the bottom of the hole, such as in the Sugden patent, or have included independent bucket means as in the Cox patent.

SUMMARY OF INVENTION

The present invention relates to a novel earth boring apparatus for digging shafts of large diameter in which a center cutting wheel and endless bucket means associated therewith are so constructed and arranged that a bowl-shaped recess is continuously cut ahead of a main cutting head to facilitate receiving and removing cuttings from the recess while both the main cutting head and the center cutting wheel are continuously operated. The invention also contemplates that in the event a main enlarged cutting head is not required that the cutting wheel and the endless bucket means associated therewith may be utilized to excavate or bore a hole with effective removal of cuttings.

The primary object of the present invention, therefore, is to provide an earth boring machine which is constructed and arranged to perform earth boring operations in a more effective and efficient manner.

An object of the present invention is to provide an earth boring apparatus for blind shafts in which a lead center hole or excavation is made, and in which the cuttings from said excavation are directly transported from the center hole to an upper part of the apparatus for collection and then disposal of the collected cuttings.

Another object of the present invention is to provide an earth boring apparatus in which a center cutting wheel provided with cutting elements is continuously rotated about a horizontal axis and is also continuously rotated at a different speed about a vertical axis corresponding to the axis of the hole being dug.

Another object of the present invention is to provide an earth-boring apparatus in which a center cutting wheel provided with cutting elements and adapted to be rotated continuously about horizontal and vertical axes may be utilized to provide a bowl or disk-shaped recess of selected depth for temporarily collecting cuttings from another cutting head or device, or in the event another cutting head is not utilized to provide a cylindrical bore and directly dispose of its cuttings.

A more specific object of the present invention is to provide a cutting wheel for excavation purposes in which the cutting wheel is provided with sprockets fixed thereto and rotatable about the axis of rotation of the wheel, the sprockets serving as one end of an endless bucket means for receiving and transporting away from the hole being dug cuttings made by the cutting elements on the cutter wheel.

A further specific object of the present invention is to provide an earth boring apparatus including a column, endless bucket means extending along said column and including sprocket means at each end of the column, a cutting wheel rotatably supported from the column for rotation about the axis of one of the sprocket means and including cutting elements extending beyond the path of said buckets, the buckets on the bucket means being spaced for location between the cutting elements on the cutting wheel as the cutting wheel is rotated about its axis.

The invention also contemplates a column means rotatable about a vertical axis and provided with a cutting means at one end including sprocket means for an endless bucket means, sprocket means also being provided at the opposite end of the column means for the endless bucket means, the cutting means including a cutter wheel mounted on said column for continuous rotation about a wheel axis normal to the longitudinal axis of the column means, the cutter wheel and column means being continuously rotated about their axes at selected different rates of speed.

A more specific object of the invention is to provide drive means for rotating the column means above-described at a selected speed and drive means for rotating the cutting wheel at a selected speed relative to the column speed in a range of approximately ten to one.

A still further object of the invention is to provide a central cutting wheel at the end of a column including endless bucket means wherein the central cutting wheel may be adjustably positioned relative to a main rotatable cutting head to provide a selected depth of lead or pilot hole.

The invention further contemplates that various modifications of the central cutting wheel and endless bucket means associated therewith may be utilized. In one modified example, the endless bucket means with buckets may be located on one side of a vertical plane and cutting elements on the wheel located on the other side of a vertical plane. In another example the cutting wheel is provided with laterally spaced circular sets of cutting elements and between said sets are provided one or more endless bucket means. In still another example, the arrangement of cutting wheel, sprockets and endless bucket means may be rotated or pivoted or swung about the intersection of a horizontal axis and a vertical axis to vary the configuration of the hole being dug.

Various other objects and advantages of the present invention will be readily apparent from the following description of the drawings in which exemplary embodiments of the invention are shown.

IN THE DRAWINGS

Figure 2:
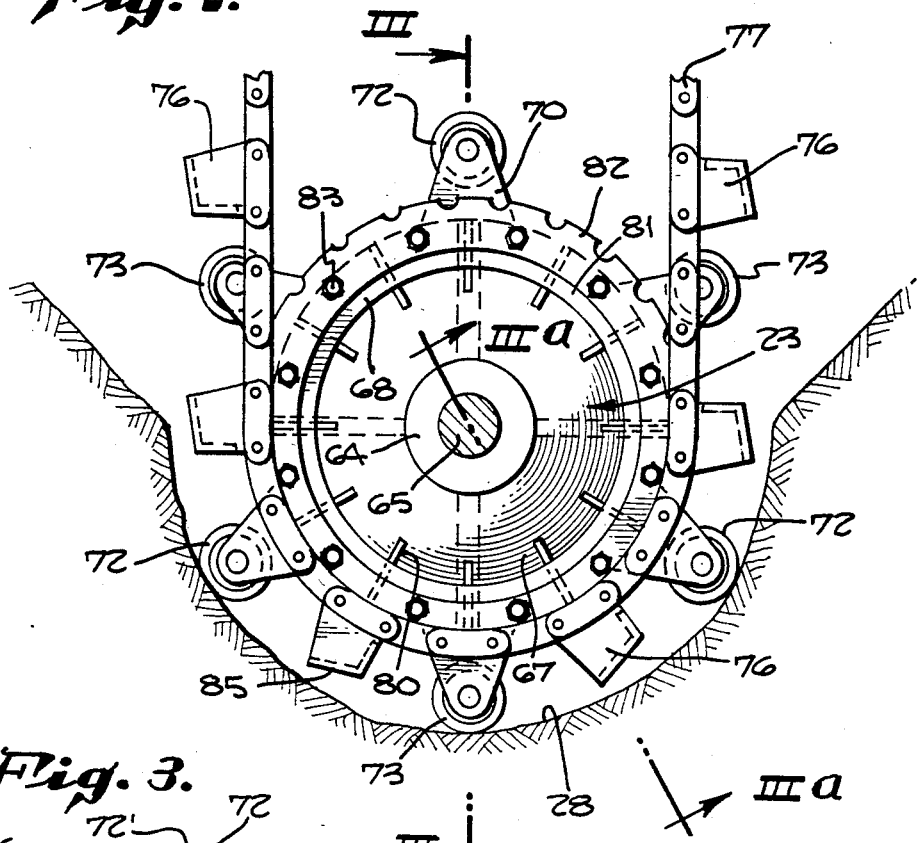
FIG. 2 is an enlarged elevational view of the central cutter wheel, sprocket and bucket arrangement shown in FIG. 1 at the bottom of the hole.
Figure 3:
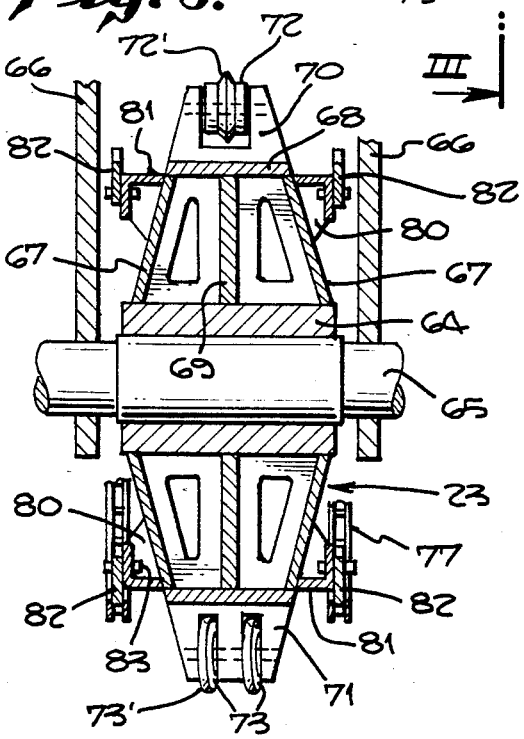
FIG. 3 is a sectional view of the cutter wheel taken in the planes indicated by lines III—III of FIG. 2.
Figure 3A:
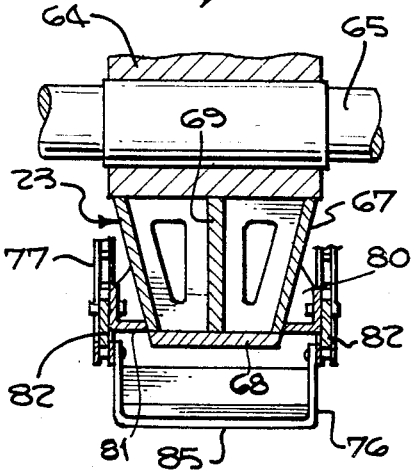

FIG. 3*a* is a fragmentary sectional view taken in the plane indicated by a radius lines III*a*—III*a* of FIG. 2.

Figure 4:
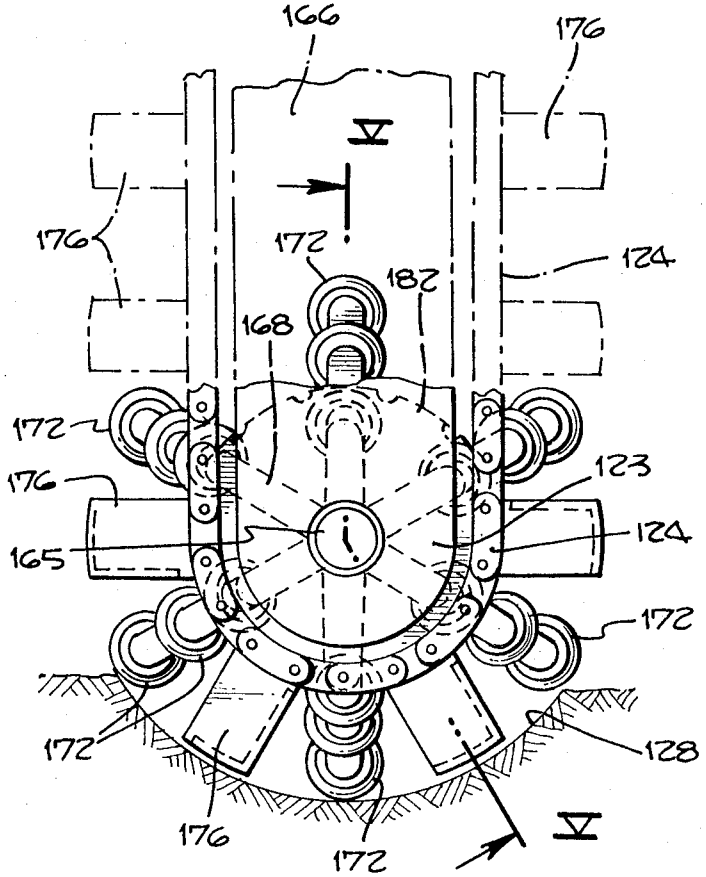

FIG. 4 is a fragmentary elevational view of a different embodiment of the cutter wheel shown in FIG. 2.

Figure 5:
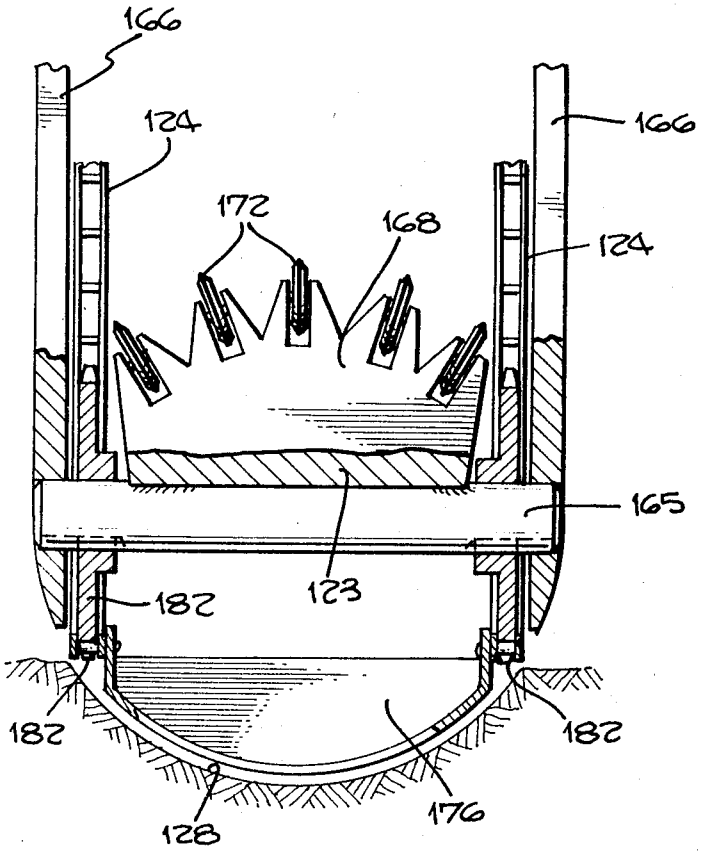

FIG. 5 is a fragmentary sectional view taken in the planes indicated by lines V—V of FIG. 4.

Figure 1:
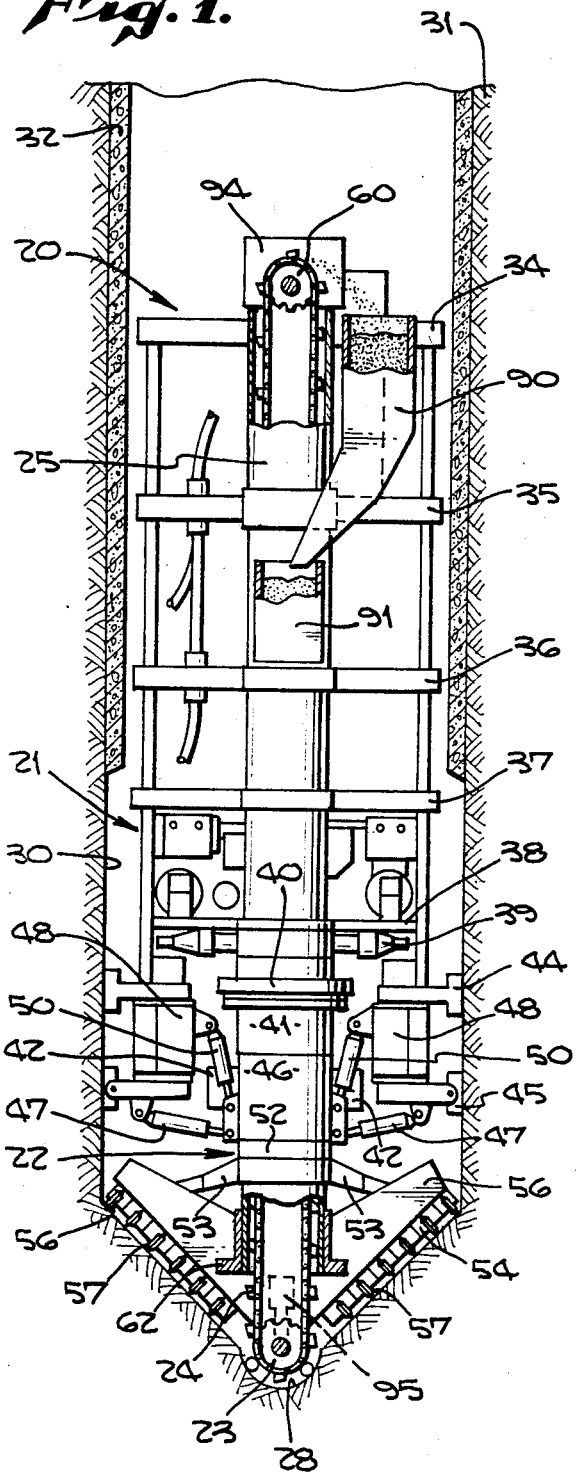
FIG. 1 is an elevational view of an apparatus embodying this invention, the apparatus being partly in section being shown in a partially excavated hole or bore in an earth formation.

FIG. 6 is a fragmentary schematic elevational view of a different arrangement of cutter wheel and endless bucket means, which may be carried by the column means shown in FIG. 1.

FIG. 7 is a fragmentary schematic elevational view of another embodiment of a cutter wheel utilized with this invention.

FIG. 8 is a fragmentary schematic elevational view of another embodiment of a cutter wheel and bucket means of this invention arranged with respect to the column means for swinging pendulum-type motion.

Figure 9:
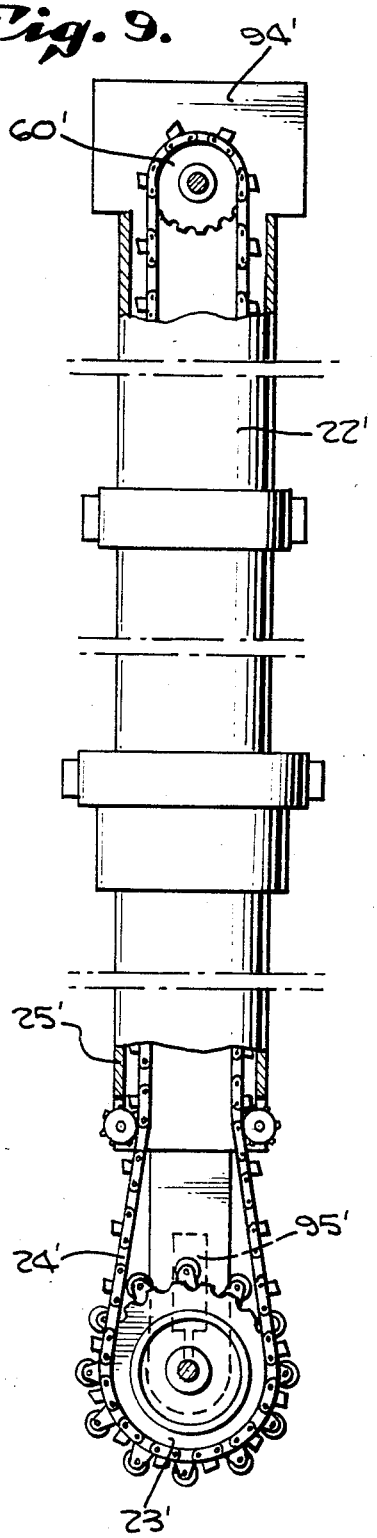

FIG. 9 is an elevational view, partly in section, of a column means, cutter wheel and endless bucket means contemplated by this invention and not associated with a second cutting head.

DETAILED DESCRIPTION

In FIG. 1 an apparatus generally indicated at 20 includes a stationary frame means 21 and a rotatable assembly 22 comprising a cutting wheel 23, and endless bucket means 24 supported from a rotatable column means 25. The assembly 22 is rotatably supported from frame means 21. Apparatus 20 is located in a shaft or hole 30 in an earth formation which has been partially excavated below the ground surface 31. The shaft 30 during its excavation may be provided with a liner 32 in accordance with known practice.

In general, the stationary frame means 21 is known in the art and will be briefly described. In the example shown in FIG. 1, it will be understood that the diameter of shaft 30 may be in the order of approximately 26 feet, and the diameter of lead recess or bowl 28 at the bottom of the shaft 30 may be in the order of approximately six feet. Frame means 21 may include a plurality of decks for equipment and operating personnel, such as a top service deck 34, intermediate service decks 35, 36, equipment deck 37, and a control platform or deck 38. Below the control platform 38 may be provided a pair of swivel yokes 39, a kelly 40, and an inner kelly extension 41. Kelly drive motors 42 are connected to the kelly by suitable means (not shown for clarity). Sets of hydraulically actuated stabilizing jacks 44, 45, are provided for gripping the sidewalls of shaft 30 to stabilize the position of the apparatus in the shaft.

Below the bottom stabilizing jack 45, each jack 45 may be interconnected with a central cylindrical member 46, through which column 25 extends, by fluid actuated steering cylinders 47. Cylindrical member 46 is also interconnected by means of thrust cylinders 50 with a frame portions 48 supporting the upper stabilizing jack 44.

Below cylindrical member 46 is a main bearing 52, which is connected through suitable arms 53 to a main cutter head 54 of conical shape. Main cutter head 54 includes a plurality of angularly-spaced cutter head members 56, which carry on their inclined downwardly-facing surfaces or edges a plurality of cutting elements 57, in this example, disk-type elements having beveled cutting edges and rotatable about axes generally parallel to the inclined faces of the conical shaped head 54. The cutting elements 57 may be of any selected type, and the number of cutting elements used on each arm or leg 56 may be changed, depending upon the type of earth formation in which the shaft is being excavated. In FIG. 1, the main cutting head 54 is shown as resting on the bottom face of the shaft, and is rotatable in bearing 52 with column means 25.

Apparatus 20 and frame means 21 including the rotatable assembly 22 may be advanced along the axis of the shaft 30 being dug by the operation of the thrust cylinders 50, the steering cylinders 47, and by the incremental advancement of the frame means 21 by successively displacing the stabilizing jacks 44 and 45. Such advancement of apparatus 20 in a shaft by use of similar equipment is known.

The present invention is generally directed to the rotatable assembly 22 including rotatable column 25, which is supported on spaced bearings along the frame means 21, an endless bucket chain means 24, which extends along said column, and cutting wheel 23 supported from the bottom of column 25 or other cutting head. At the top of assembly 22, the bucket chain means 24 turns about chain sprocket means 60, the shaft of the sprocket means 60 being suitably rotatably mounted in the upper end of column means 25, so that the sprocket means 60 may turn with column means 25 during rotation about the column vertical axis. The endless bucket chain means 24 extends downwardly through column means 25 to cutting wheel 23. Column means 25 at the bottom thereof is received within the hub structure 62 of main cutting head 54. In this example, the lower end of the column means 25 is fixedly connected to hub structure 62 so that the column 25, together with the endless bucket chain means 24 carried thereby and the cutting wheel 23, may be rotated about the vertical axis of column 25 and the axis of the shaft 30 being bored.

Cutting wheel 23 shown in FIG. 1 is exemplarily illustrated in FIGS. 2 and 3. Cutting wheel 23 includes a cylindrical hub 64 through which a wheel axle 65 passes for rotatable anti-friction bearing support in a yoke mounting 66 therefore extending from the bottom end of the column 25. Extending outwardly from hub 64 are converging wheel walls 67, which terminate in an outer cylindrical rim 68, having a selected width. Rim 68 may be further structurally supported by an annular internal wall 69 extending from rim 68 to hub 64.

At circumferentially-spaced locations on wheel rim 68, a plurality of blocks 70 and 71 are provided for mounting cutting elements 72 and 73 about axes generally parallel to the axis of wheel shaft 65. Mounting blocks 70 and 71 provide sufficient space therebetween at the circumference of the wheel for reception therebetween of a bucket 76 of suitable size and configuration. In this example, six cutting elements 72, 73, are provided on cutting wheel 23. Cutting element 72 may be a single cutting disk having a beveled cutting edge 72' adapted to contact the earth formation along a vertical plane passing through the axis of the column 25.

Cutting elements 73 are alternately spaced between cutting elements 72 and include cutting disks having beveled cutting edges 73', which engage the earth formation at the face of the shaft spaced from the vertical plane passing through the axis of the column 25 and the cutting edge 72'. While in this example the cutting disks 73 are shown in parallel relation and with the cutting edges 73' apparently lying in a plane tangential thereto, it will be understood that the circumferential edge 73' on a disk 73 willl ie along a radius normal to the axis of wheel shaft 65, which is slightly less than the radial distance of cutting edge 72' of the other cutting elements 72. In effect, the remote radial points on the circumference of the cutting edges 73' and 72', when viewed from a center point on the axis of the shaft 65, at the vertical plane passing through the longitudinal axis of column 25 and bisecting the cutting wheel, such points will lie on an arc formed by a radius measured from such center point on the shaft.

Also, while in FIGS. 2 and 3, the pair of cutting disks 73 have been illustrated as one disk of each pair being on opposite sides of such axial vertical plane, it will be understood that various arrangements of cutting disks may be used relative to such a vertical plane of reference. For example, in some instances, the pair of cutting disks may be set to one side of the plane, and the next pair of disks on the circumference to a different or opposite side of the plane. Wheel rim 68 may be increased in width to accommodate such different mounting arrangements of the cutting disks or of other types of cutting elements.

Endless bucket means 24 includes an endless bucket chain 77, having buckets 76 fixedly carried on said chain and spaced along said chain so that as the buckets 76 approach the cutting wheel and begin to turn thereabout, the buckets 76 will be located between the cutting elements 72, 73, with sufficient clearance so that there will be no interference of a bucket with a cutting element.

Cutting wheel 23 thus serves as one end of endless bucket means 24. Converging walls 67 of the wheel may support outwardly extending gussets 80, which are connected as by welding to angle section flanges 81, which carry sprockets 82 on each side of wheel 23. In this example, each sprocket 82 comprises an annular ring secured to flange 81 as by rivets or bolts 83, and become a unitary part of wheel 23. The diameter of the outer circumference of the teeth of sprocket 82 is less than the diameter of the circumference formed by the cutting elements 72, 73, and is also less than the circumferential path of buckets 76 moving around the wheel 23 at the bottom of the hole.

Each bucket 76 is secured and fixed on chain 77 and includes a suitable shape and capacity to effectively remove cuttings from the bowl 28 being formed by the cutter elements 72, 73 and by main cutter head 54. Each bucket 76 may include an outer wall 85 having a width which may extend to or outwardly laterally flared slightly beyond the planes of the pair of sprockets 82. Each bucket 76, as it leaves the bowl 28 with cuttings therein, is carried by the endless chain upwardly through the column 25 to the top sprocket means 60, where each bucket, as it commences its downward path, discharges the cuttings into a bin feeder 90. Since column 25 is turning about its vertical axis, a carousel type receptacle 94 may be provided at the top of column 25 to receive cuttings discharged from buckets rotating through 360°. Bin feeder 90 conveys by gravity the cuttings to a skip 91 located at one side of column 25. When skip 91 is filled, it may be lifted by suitable crane means to the ground surface 31 and disposed of in suitable manner.

Motor means 95 for rotating wheel 23 about its horizontal axis may be carried at the bottom of the column 25. Motor means 95 may include suitable drive means (not shown) connected with the axle 65 of the cutting wheel. In this example of the invention, motor means 95 may rotate the cutting wheel 23 at approximately 10 times the speed or revolutions per minute of the rotation of central column 25 which is driven by the kelly drive motors 42. Cutting wheel 23 may be driven by its motor 95 at selected revolutions per minute suitable for collecting the cuttings in the bowl 28, for example, at a speed of approximately 10 to 20 revolutions per minute. The kelly motors 42 may rotate the main cutting head 54 at a suitable relative speed, such as two to three revolutions per minute. Depending upon the earth formation and the type of and quantity of cuttings produced by the main cutter head and the central cutting wheel, the relative speeds of rotation of the main cutter head and cutting wheel may be controlled and varied so that the bucket means 24 may remove the optimum quantity of cuttings.

In operation of apparatus 20, it will be understood that cutter head 54 may rest upon the bottom face of shaft 30, and part of the weight of the frame means 21 and cutter head 54 will be transferred to the cutting elements carried thereby as they rest upon the face of the shaft. The frame is stabillized by the laterally-extending grippers 44 and 45. As main head 54 is rotated, cuttings from the main head fall by gravity along the slope of the conical face of the shaft and into lead center bowl 28, which is being formed in advance of the cone-shaped main face of the shaft by continuous rotation of the cutting wheel 23 about both horizontal and vertical axes. The cutting elements 72, 73 on cutter wheel 23 during continuous rotation about the cutter wheel axis, and during rotation of the main head and column 25, and the continuous sweeping of the bowl 28 by buckets 76 provide for continuous removal of cuttings falling into the bowl 28 and the direct conveyance and transfer of said cuttings from the bowl 28 to the feed bins 90.

In the combined cutting and removal of cuttings achieved by the cutting wheel 23 and endless bucket means 24, at least one cutting element is arranged to move in the vertical plane which passes through the column axis and which is normal to the horizontal axis of the cutting wheel. A part spherical recess or bowl is thus made. The depth of said recess may be varied by moving the rotatable column means 25 relative to the main cutting head 54. Means for making such adjustment may include suitable fluid actuated cylinder means to move the hub structure of the main cutter head 54 relative to the column means.

The example of cutting wheel 23 shown in FIGS. 2 and 3 include the spacing of six cutting disks about the cutter wheel axle 65. The invention contemplates that more or less cutting disks may be spaced about the circumference of the cutting wheel 23, depending upon the diameter of the wheel and the size of the bowl to be cut in advance of the main cutting head 54. A change in circumferential spacing of the cutting disks will require a change in spacing of the buckets 76 on the endless bucket chain and, in some instances, on the size of bucket 76 depending upon the type of main cutting head and the type of operation of the apparatus 20.

In FIGS. 4 to 9 inclusive, different embodiments of the invention are shown, particularly the construction and arrangement of the cutting wheel 23 and endless bucket means 24. In the following description similar parts will be given the same reference numeral in multiples of 100.

In FIGS. 4 and 5, a different modification of the cutting wheel is shown, which may be used with column 24 and an endless bucket chain means 24 similar to that shown in FIG. 1. In FIGS. 4 and 5, the construction of the wheel 123 may be generally similar to that described in FIGS. 2 and 3. The outer circumference of the cutting wheel is provided with an arcuate or part spherical wheel wall 168 provided with a row of cutting disks 172 arranged with the plane of the disks lying on a radius which is centered at the center point of the arcuate or part spherical wall 168. The wheel 123 is supported by a wheel shaft 165 carried by supporting yoke arms 166 which are mounted on the bottom end of the column 25 (not shown). As in the prior wheel example, sprocket teeth 182 are provided at the circumference of the wheel at each side thereof and are fixed as by welding or other suitable means to wheel 123. Bucket chain means 124 includes a plurality of spaced buckets 176, which are spaced on the chain 124, so that they will engage sprockets 182 between the rows of cutting disks 172. In this type of arrangement with a part spherical or arcuate row of cutting disks, it is contemplated that the bucket elevator 124, and the cutting wheel 123, will rotate only about the horizontal axis of the shaft 165.

Still further modifications of cutting wheels which may be utilized with apparatus 20 and rotatable assembly 22 are shown in FIGS. 6, 7 and 8. In FIG. 6, a bucket chain means 224 is located at one side of a vertical plane passing through the horizontal center of the cutting wheel 223. Along such a vertical plane cutting wheel 223 may be provided with cutting elements 272 in the form of picks. On the opposite side of the vertical plane may be provided laterally-spaced cutting disks 273 carried by suitable mounting blocks 271 secured in any suitable manner to the circumferencial surface of cutting wheel 223. The cutting edges of cutting elements 273 and the picks 272, and also the outboard corner of buckets 276, may lie in a shallow arc to facilitate cutting of the earth formation and operation of the wheel cutting means 223 without interference.

In this modification of the cutting wheel, the spacing and number of buckets on the endless bucket means 224 does not require precise correlation with the spacing of the cutting elements. Since the wheel 223 is part of a rotatable assembly 222, the buckets will traverse almost the entire surface of bowl 228.

In FIG. 7, cutting wheel means 323 includes laterally or axially-spaced circularly arranged cutting elements 372 providing a central set of cutting elements and two outboard sets of cutting elements, in this example in the form of picks. Between the outboard and central cutting elements on wheel means 323 there may be provided two endless chain bucket means 324 and 324'. The buckets 376 lying between adjacent picks provide means for collecting and directly transporting cuttings made by the picks from a lead bowl 328 in a shaft being formed.

In FIG. 8, a different embodiment of cutting wheel means is shown in which the cutting wheel 423 is provided not only rotation about a vertical axis and its horizontal axis, but is also provided pivotal or swinging movement about a pivot point or axis 489 on the vertical axis of column means 425 at a selected distance above wheel axis 465. Such swinging movement may be controlled by fluid cylinder pressure means 467 on opposite sides of cutting wheel 423 and pivotally connected at their lower ends to arms 466 at 468 and their upper ends to a portion of column means 425 as at 469. Cutting wheel 423 is schematically illustrated and may be generally of the type shown in the first embodiment of this invention and includes cutting disks 472 and cutting disks 473. Bucket means 476 are provided on an endless bucket means 424 as in the prior embodiments.

From a consideration of FIG. 8, it will be understood that when the cutting wheel 423 is swung about axis 489 without any rotation of the column means 425 about its vertical axis, the shape of the shaft 430 being cut will be generally polygonal and could be either square or rectangular. When the wheel 423 is rotated about its horizontal axis and also swung about axis 489 while the column means 425 is being turned about its vertical axis, the shape of the shaft 430 being cut will be circular. It should also be noted that the diameter of the cut being made depends upon the extent of the swinging motion.

It will also be understood that cutting wheel 23 with sprockets 82 to directly associate with the cutting wheel an endless bucket means 24 may be employed with other types of shaft excavating cutter heads. One example of such other cutting heads is the type which cuts the face of the shaft in the general configuration of a "W" as suggested in U.S. Pat. No. 3,965,995. The present invention contemplates that the rotatable assembly 22 of the present invention would be located on the axis of the shaft being bored so as to provide excavation of a lead hole along such axis while side cutters make an annular excavation around the center hole or recess being excavated by the cutter wheel of this invention. In the excavation of a shaft face of "W" configuration as mentioned above, the side cutters employed would rotate in a direction to throw cuttings toward the center hole where the bucket means of the present invention would collect and convey the cuttings to the top end of the column means as previously described.

In such use of the concept of this invention with different types of excavating heads, it will be understood that a rotatable assembly 22' as shown in FIG. 9 may be associated with such other cutting heads. In FIG. 9 in which the rotatable assembly 22' is shown without association with any other cutting head, it will be apparent that the cutter wheel means 23', the endless bucket chain means 24', the rotatable column means 25' and the wheel drive means 95' may readily be employed as an independent operating unit for digging a shaft of relatively small diameter such as 9 feet or the width or the diameter of the cutting wheel 23'. Such a rotatable assembly 22', when used as an independent unit, may be supported from a modified stationary frame means similar to frame means 21. The rotatable assembly 22' shown in FIG. 9 is not further described in detail for purposes of brevity, since the structure therein includes the structure described in detail with respect to the rotatably assembly 22 shown in FIG. 1 and the several modifications of cutting wheels as shown in FIGS. 2–7, inclusive.

While various types of cutting elements have been shown and described, it will be understood that the cutting elements employed on the cutting wheel of this invention may include different arrangements of disks, multidisks, carbide buttons, and picks with carbide inserts.

The advantages of a rotatable assembly such as 22 associated with or not associated with a second cutting head to provide a lead or pilot hole in blind shaft boring and to employ the drive means for the cutting wheel to serve as a drive means for an endless bucket means provides an effective, efficient arrangement for excavation of shafts of substantial width. It will also be understood that the endless bucket means may be driven at the top sprocket means 60 by suitable drive motors synchronized with the drive motor 95 for the wheel 23.

Various other modifications and changes may be made in the earth boring apparatus described above which come within the spirit of this invention of all such changes and modifications coming with the scope of the appended claims are embraced thereby.

We claim:

1. In an earth boring apparatus adapted to continuously excavate a pilot hole by rotation about two axes while simultaneously continuously excavating a main shaft, by rotation about one of said axes, the combination of:

an elongated frame means;

an elongated column means within said frame means and having a through passageway;

a main cutting head of conical form carried by the lower end of said column means;

first drive means on said frame for continuously rotating about a first axis said column means and said main cutter head at a selected speed;

an endless bucket means extending along said column passageway and having a lower portion extending below said main cutter head;

spaced sprocket means for the lower portion of said endless bucket means and having a hub rotatable about a second axis normal to the first axis and below said main cutting head;

a cutter wheel on said hub between said spaced sprocket means and rotatable with said sprocket means about said second axis and with said column and main head about said first axis;

said cutter wheel having spaced cutter elements projecting therefrom;

said bucket means having buckets spaced a selected distance apart to receive therebetween a cutter element as said cutter wheel rotates and said endless bucket means travels around said sprocket means;

a second drive means for continuously rotating said cutter wheel and said sprocket means about said second axis while said main cutter head and said cutter wheel is continuously rotated by said first drive means about said first axis;

the extension of said column lower portion below said cutter head and the continuous rotation of said cutter wheel and sprocket means about both axes continuously excavating a pilot hole and disposing of cuttings from said cutter wheel by said bucket means for reception of additional cuttings from said main cutter head and the direct removal of all of said cuttings from said pilot hole directly to the opposite end of said endless bucket means.

2. An apparatus as stated in claim 1, including:

drive means at the opposite end of the column synchronized with the wheel drive means for rotating the sprockets at the said opposite end of the column means.

3. An apparatus as stated in claim 1 including:

said cutting wheel drive means being rotated at a speed relative to the column rotatable speed in the range of approximately ten to one.

4. An apparatus as stated in claim 1, including:

means for varying the revolutions per minute of the cutter wheel relative to the revolutions per minute of the column.

5. An apparatus as stated in claim 1 including:

means on said column means for adjustably positioning said cutter wheel on said first axis relative to the position of said main cutting head.

6. An apparatus as stated in claim 1 wherein said cutting wheel includes cutting elements arranged on one side of a plane passing through said cutting wheel normal to the axis of rotation of said cutting wheel, and said bucket means includes buckets arranged on the opposite side of said plane normal to the axis of rotation of said cutting wheel.

7. An apparatus as stated in claim 1 wherein:

said cutter wheel includes a part-spherical rotatable cutter member provided with cutting elements on its part-spherical surface.

* * * * *